United States Patent [19]

Johnson

[11] 3,992,827

[45] Nov. 23, 1976

[54] COPING ASSEMBLY WITH DEFORMABLE SEAL CLAMP

[76] Inventor: Philip L. Johnson, 1929 Stanford Drive SE., Grand Rapids, Mich. 49508

[22] Filed: July 7, 1975

[21] Appl. No.: 593,274

[52] U.S. Cl. ..... 52/60; 52/94; 52/600

[51] Int. Cl.[2] ..... E04D 1/36

[58] Field of Search ..... 52/58, 60, 61, 62, 300, 52/96, 470, 528, 94, 63, 222

[56] References Cited

UNITED STATES PATENTS

| | | | |
|---|---|---|---|
| 2,857,861 | 10/1958 | Trostle | 52/94 |
| 3,461,625 | 8/1969 | Sandow | 52/58 |
| 3,719,010 | 3/1973 | Hickman | 52/60 |
| 3,777,425 | 12/1973 | Le Bourgeois | 52/63 X |

*Primary Examiner*—Price C. Faw, Jr.
*Assistant Examiner*—Carl D. Friedman
*Attorney, Agent, or Firm*—Price, Heneveld, Huizenga & Cooper

[57] ABSTRACT

A deformable clamp is connected to a building parapet, wall or the like which extends above a roof deck for clamping a resilient sealing strip of roofing material thereto thus providing a readily formed watertight seal between the roof and the wall.

5 Claims, 4 Drawing Figures

COPING ASSEMBLY WITH DEFORMABLE SEAL CLAMP

BACKGROUND OF THE INVENTION

1. Field of Invention

The invention relates generally to building structures and more particularly to the interconnection of a roof deck to a wall or the like extending above the roof at an edge thereof.

2. Prior Art

Roof decks are typically characterized by having a low pitch or a substantially horizontal surface. A raised wall around the perimeter of the roof permits rainwater to be controlled without spilling over the edge of the roof. Additionally, such walls can also serve as a barrier for roof covering materials such as gravel or the like. Further, the walls, when covered with decorative panels (i.e., fasciae) enhance the appearance of a building. Various means have been suggested for connecting the roofing material to the raised wall and to provide a barrier against the penetration of water either through the roof, the wall or the junction of the roof and the wall.

U.S. Pat. No. 3,719,010 issued to J. B. Hickman on Mar. 6, 1973 teaches a relatively complex inverted U-shaped member with a clamping structure facing outwardly from the inner side of the wall of the building for receiving a locking structure which is coupled to the edge of the roofing material. The roofing material extends toward the U-shaped member and is clamped from both sides by flashing strips having flanged end portions. The flashing strips are connected to each other and to the intervening roofing material by means of a screw. The flanged end portions of the flashing strips holding the roofing material are mated with the clamping structure of the U-shaped member. Coupling of the clamping structure and the flashing strips is typically accomplished on the roof with the flanged end portions of the flashing strips properly aligned to mate with the clamping structure. Accordingly, the relative alignment of the two flashing strips and the roofing material with the clamping structure must be maintained while the screws are inserted through the flanges and the roofing material.

Such an assembly procedure is difficult and time-consuming thereby greatly increasing costs of construction. Additionally, the insertion of an exposed screw through the flashing and roofing material provides a natural point for the beginning of a leak. Pressure on the roofing material is not even throughout its connection to the flashing and is greater at the points where the screws are inserted. Such localized pressure zones may provide a focal point for the starting of breaks or cracks in the roofing material or flashing. As a result, water may not only seep through the roofing material around the edges of the screw, but through cracks in the roofing material starting at the screw. A similar structure where roofing material is compressed between two separate flange members and secured by means of screws is taught in U.S. Pat. No. Re. 27,761 issued to J. J. Attaway on Sept. 18, 1973.

U.S. Pat. No. 3,738,068 issued to J. J. Attaway on June 12, 1973 also teaches compressing roofing material between two separate flanges. However, instead of driving screws through the flanges and the intervening roofing material, a fixed overhanging flange supports a screw driven through the overhanging flange and screwed down onto the flange covering the roofing material thereby compressing the roofing material between the two flanges. During installation, care must be taken to prevent the screws from puncturing through the roofing material. Even so, there are fixed pressure points which may damage the roofing material and promote cracks and leaks. Additionally, there remains the need to individually adjust screws at even pressures to provide a suitably tight uniform seal. Further, the separate flanges and the roofing material must be simultaneously correctly aligned when the screws are tightened to secure the assembly. This assembly procedure may also be prone to being relatively time-consuming and difficult to install thereby increasing costs of construction.

SUMMARY OF THE INVENTION

This invention teaches an assembly for connecting roofing material to a wall surrounding the roof deck by providing an easily installed seal around the perimeter of the roof. The seal is installed in a relatively quick operation minimizing alignment problems. In addition to providing a seal having uniform pressure along its length thus virtually eliminating cracking strains, no screws are required, thereby eliminating this costly and timeconsuming installation step which can easily cause leaks. The present invention permits a seal to be installed to the mounting structure separately from the attachment of the mounting structure to the wall surrounding the roof. This also simplifies the construction problem by permitting rapid installation of preassembled units. The invention achieves these advantages while providing an uncomplicated mounting structure which can be inexpensively extruded.

Apparatus embodying the present invention includes a clamp having a pair of spaced legs extending outwardly permitting sealing material to be placed between the legs. At least one leg is movable with respect to the remaining leg is sealably clamp the sealing material therebetween.

In one embodiment, the legs include ridges or grooves which can interact to better secure the roofing material between the legs. The snap lock clamp so formed may include a portion extending over and attached to the wall surrounding the roof deck. Further, the snap lock clamp in some embodiments can serve as a supporting member for an inverted U-shaped coping member covering the top of the wall and attached to the snap lock clamp.

DETAILED DESCRIPTION OF THE PREFERRED EMBODIMENT

Figure 1:
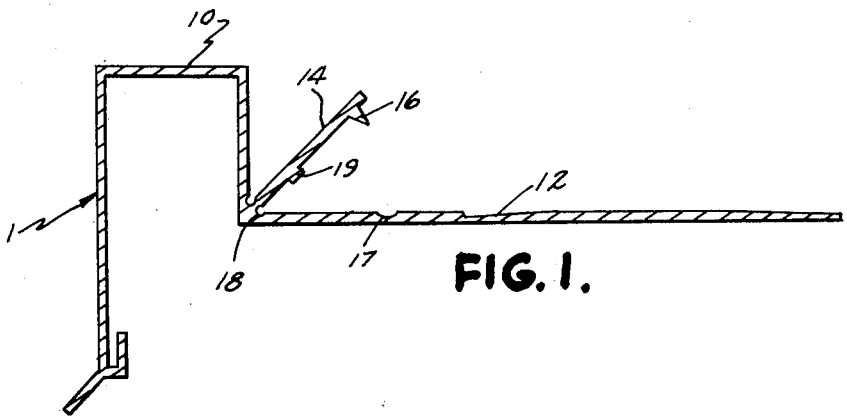
FIG. 1 is a cross section of a gravel stop coping including a deformable clamp in accordance with one embodiment of this invention.

Referring initially to FIG. 1, a one-piece integral gravel stop 1 includes an inverted U-shaped segment 10 which can fit over a raised wall at the perimeter of a roof and an attached horizontally extending segment 12 which can extend over a lower stepped portion of the wall or over the roof itself. A clamping leg 14 is connected to gravel stop 1 at the junction of inverted U-shaped segment 10 and horizontal segment 12. Leg 14 can be rotated down toward horizontal portion 12 by deformably bending the leg to clamp sealing material therebetween. Advantageously, leg 14 has a protrusion 16 extending toward leg 12 to better clamp the sealing material between leg 14 and the leg defined by segment 12. The junction 13 of leg 14 to the remainder of gravel stop 1 is narrowed to more easily permit deformation to take place when leg 14 is rotated. Also, this permits leg 14 to lie substantially parallel to leg 12 when installed as shown in FIG. 2.

Typically, leg 12 includes an indentation 17 which is designed to cooperate with protrusion 16 and improve clamping of sealing material 34 (FIG. 2) therebetween. Similarly, an intermediate protrusion 19 is provided and extends toward leg 12 to apply a compressive force on sealing material 34. Gravel stop 10 is integrally formed by extrusion of a deformable material such as aluminum. Sealing material 34 was, in the preferred embodiment, a sheet strip of Neoprene flashing approximately 1/16 inch thick with a width of 12 inches.

Figure 2:
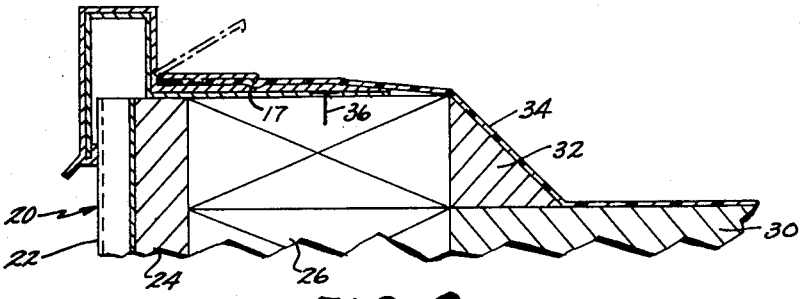
FIG. 2 is a cross section of the structure of FIG. 1 after installation.

FIG. 2 shows a typical installation of gravel stop 1. Wall 20 has a layered structure including an exterior panel 22, a backup panel 24 and nailers 26. The transition of wall 20 and roof 30 includes a cant strip 32 providing an angled connection between roof 30 and wall 20 thereby avoiding a 90-degree bend in material 34. The gravel stop 1 is attached to wall 20 by means of a plurality of horizontally spaced nails 36, driven vertically through leg 12 and into nailers 26. After securing gravel stop 1 to the wall, the sealing strip 34 is placed on leg 12 and extended up to the junction of horizontal legs 12 and 14. A bead of Neoprene caulking material can be injected under leg 14 at the junction of material 34 and leg 12 if desired. Leg 14 is deformed by rotating downwardly by hitting it with a mallet at spaced intervals. Typically, to avoid undesired deformation of leg 14 and to spread the force of a striking mallet, a wooden block can be placed on the leg during this step.

Figure 3:
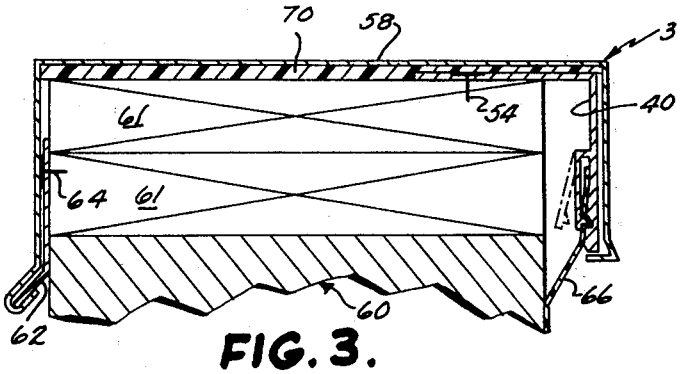
FIG. 3 is a cross section of a snap-on coping including a deformable clamp in accordance with another embodiment of this invention.
Figure 4:
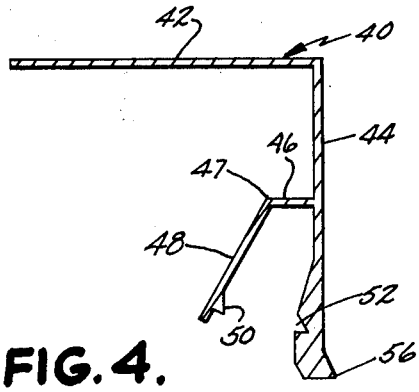
FIG. 4 is a cross section of a deformable clamp which can be employed as part of the structure of FIG. 3.

FIG. 4 shows a snap lock clamp 40 used as part of a fascia assembly 3 in FIG. 3. Clamp 40 has a horizontal member 42 generally designed to extend over the top of a wall and a vertical downwardly extending leg 44 generally designed to extend down alongside and spaced from the inside face of a wall adjacent a roof deck. A horizontal extension 46 extends from vertical leg 44 towards the inside face of a wall. A leg 48 is integrally coupled to extension 46 and extends generally downwardly therefrom. Leg 48 is deformably bent at its junction 47 with leg 44 for clamping a resilient flashing strip 66 (FIG. 3) between legs 44 and 48. Leg 48 includes a protrusion 50 which mates with an indentation 52 on leg 44 for compressing a roofing material places therebetween. To facilitate the bending of leg 48, a junction 47 can be slightly thinner than leg 48 and extension 46.

Snap lock clamp 40 is attached to the inner face of a wall 60 in spaced relationship thereto by means of a plurality of horizontally spaced nails 54 driven vertically through horizontal member 42 into nailers 61 as shown in FIG. 3. Advantageously, a snap lock clamp 40 is positioned with relation to the wall so it can securely engage a subsequently mounted coping section. A protrusion 56 (FIG. 4) extending from the bottom of member 44 generally outward away from the wall is used as an anchor for an inverted U-shaped coping section 58 which covers the top and sides of nailers 61 and a portion of wall 60. To anchor the other end of coping section 58 on the outside of the front face of wall 60, a front clip 62 is attached to the outside of wall 60. Typically, front clip 62 has an outwardly extending flange for engaging a portion of inverted U-shaped coping section 58. A plurality of horizontally spaced nails 64 driven horizontally through clip 62 into nailers 61 secure the clip to wall 60.

A sealing material 66 such as a Neoprene strip is inserted between vertical leg 44 and leg 48 of snap lock clamp 40 and secured by bending leg 48 against leg 44. If desired, a bead of caulking material can be injected between sealing material 66 and clip 40. Again, a wooden block can be placed over leg 48 and struck by a mallet to bend leg 48 from the position shown in phantom in FIG. 3 into position to compress material 66 thereby holding it in place and forming a watertight seal along the perimeter of the roof 66. Snap lock clamp 40 can be then attached to wall 60. When clamp 40 and front clip 62 are in place, coping portion 58 can be inserted over wall 60 and engage the flanges of clip 62 and clamp 40 thereby securing coping 58 into place. Typically, a mallet blow is sufficient to snap coping 58 into place. If desired, a Neoprene gasket 70 (FIG. 3) can be placed on top of upper nailer 61 and under coping 58 to cushion the installation of the coping and to provide an upward pressure on the coping for positively securing it against the engaged flanges of clip 62 and clamp 40. Sealing member 66 extends downwardly and inwardly against the inner side of wall 60 and is sufficiently long to extend under the final roofing coating. As with the FIG. 1 embodiment, member 40 and coping 58 are extruded of a material such as aluminum. Seal 66 can be of the same material and dimensions as seal 34 but may be a somewhat wider strip to extend sufficiently down and under the final roof coating.

As can be seen from the above described embodiments of the invention, there are no exposed nail heads which may provide a path for water to enter. Further, the seal formed around the perimeter of the roofing material is of an equal pressure around the entire perimeter thereby providing no focal point for the beginning of cracks. Also of particular significance is the ease with which such structure can be manufactured and installed. Compressing a deformable leg against roofing material is manifestly easier and faster than inserting screws at spaced intervals around the perimeter of the roofing material to provide a compression seal. Indeed, no screws need be used in a typical installation. Advantageously, nails can be used to secure the clamps and the clips to a wall and save time during construction. Alternatively, an adhesive material can be used to secure the clamps and clips to the wall. The Neoprene seals and the gasket 70 permit some give as settling occurs to assure the watertight seal is maintained as the building settles after construction.

Various modifications to the preferred embodiment will, no doubt, occur to those skilled in the various arts to which this invention pertains. For example, the legs which serve to compress roofing material between them may have a different configuration from that disclosed above. Additionally, the remaining fascia associated with a deformable clamp in accordance with this invention can have a different configuration depending upon the construction of the wall and the aesthetic appearance desired. These and all other variations which basically rely on the teachings through which this disclosure has advanced the art are properly considered within the scope of this invention as defined by the appended claims.

The embodiments of the invention in which an exclusive property or privilege is claimed are defined as follows:

1. Means providing a watertight coupling between a wall and a roof comprising:

a clamp integrally extruded of aluminum having a generally vertical orientation along a wall and having first and second legs extending therefrom in spaced relationship for receiving therebetween planar seal means, at least one of said legs deformably movable to compress said planar sealing means between said legs, a deformable connection between said first leg and said second leg having a reduced thickness;

a protrusion extending from said first leg in a direction towards said second leg;

an indentation formed in said second leg at a location such that said protrusion of said first leg is aligned with said indentation when said sealing means is compressibly held between said legs;

a snap lock clip for attachment to a wall on a side opposite said clamp; and a coping shaped to extend over a top of the wall and be secured at opposite ends by said clip and said clamp;

said coping being exterior of, fitting around the vertical extent of and under at least a portion of said clamp so as to generally enshroud said clamp for protection and shielding thereof, said coping also including flange means for securing said coping over top a wall; and said snap lock clip and clamp each including extending means for interconnection with said flange means on said coping to hold said coping over the top of a wall without the necessity of using screws, nails, or other fasteners which would protrude therethrough to retain said coping in place.

2. A coping assembly for covering the top of a wall element adjacent to a roof comprising:

a snap lock clamp for attachment to a wall, said clamp including a deformable seal holding clamp, having a generally vertical orientation, extending along the interior side of the wall when said clamp is installed and a flanged end extending away from the wall;

a front clip for attachment in a generally vertical orientation to the wall and having a flanged end extending away from the front face of the wall; and a one-piece coping member shaped as an inverted "U" having flanged ends so the coping member can be placed over the top of the wall with the flanged ends of the coping member engaging the flanged ends of the front clip and the snap lock clamp thereby securing the coping member to the wall without the need for screws, nails, or other fasteners protruding through the coping member, at least one of said flanged ends extending over, around the vertical extent of, and under at least a portion of said deformable seal holding clamp so as to generally enshroud said clamp to protect and shield said clamp.

3. A coping assembly as defined in claim 2 wherein said deformable clamp comprises:

a first segment for coupling the clamp to the wall;

a second segment extending from said first segment and along the interior side of the wall and spaced from the wall;

a flanged portion extending from said second segment away from the interior side of the wall adapted to engage said inverted "U" coping member; and a deformable leg extending from said second segment toward the inner surface of the wall and rotatable toward said second segment thereby compressing a seal between said deformable leg and said second segment.

4. A coping assembly as defined in claim 11 further comprising:

a protrusion extending from said deformable leg toward said second segment; and an indentation in said second segment aligned with said protrusion for locking said seal in place when said deformable leg is rotated toward said second segment.

5. Apparatus providing a watertight seal between a wall and roof comprising:

a clamp oriented vertically and secured along a wall and including a pair of legs, at least one of which is deformable toward the other, for holding a generally planar sealing means therebetween to cover the joint between the wall and roof;

a one-piece coping member extending over the top of the wall and extending downwardly over, around the vertical extent of, and under at least a portion of said clamp for generally enshrouding, protecting, and shielding said clamp and maintaining a watertight seal between said wall and roof; and interconnecting flange means on said clamp and coping member for securing the two together without the need for screws, nails, or other fasteners protruding through said coping member.

* * * * *

UNITED STATES PATENT AND TRADEMARK OFFICE

CERTIFICATE OF CORRECTION

PATENT NO. : 3,992,827

DATED : November 23, 1976

INVENTOR(S) : Philip L. Johnson

It is certified that error appears in the above-identified patent and that said Letters Patent are hereby corrected as shown below:

Column 2, line 26:
"timeconsuming" should be --- time-consuming ---.

Column 3, line 10:
"13" should be --- 18 ---.

Column 3, line 57:
"places" should be --- placed ---.

Column 3, line 64:
After "Advantageously," delete --- a ---.

Column 5, line 27:
After "clamp;" delete --- and ---.

Column 6, line 29:
"11" should be --- 3 ---.

Signed and Sealed this

Twenty-second Day of March 1977

[SEAL]

*Attest:*

RUTH C. MASON
*Attesting Officer*

C. MARSHALL DANN
*Commissioner of Patents and Trademarks*